US007841865B2

(12) United States Patent
Maughan et al.

(10) Patent No.: US 7,841,865 B2
(45) Date of Patent: Nov. 30, 2010

(54) ORIENTATIONLESS SPRING PROBE RECEPTACLE ASSEMBLY

(75) Inventors: Michael Maughan, Moscow, ID (US); Fred Jessup, Moscow, ID (US); Erik J. Cegnar, Moscow, ID (US); David G. Alexander, Moscow, ID (US)

(73) Assignee: Ivus Industries, LLC, Moscow, ID (US)

( * ) Notice: Subject to any disclaimer, the term of this patent is extended or adjusted under 35 U.S.C. 154(b) by 0 days.

(21) Appl. No.: 12/563,616

(22) Filed: Sep. 21, 2009

(65) Prior Publication Data

US 2010/0075513 A1 Mar. 25, 2010

Related U.S. Application Data

(60) Provisional application No. 61/098,692, filed on Sep. 19, 2008.

(51) Int. Cl.
*H01R 12/00* (2006.01)

(52) U.S. Cl. ..... 439/66

(58) Field of Classification Search ..... 439/66
See application file for complete search history.

(56) References Cited

U.S. PATENT DOCUMENTS

| | | | | |
|---|---|---|---|---|
| 2,860,316 | A | 11/1958 | Watters et al. | |
| 3,193,636 | A | 7/1965 | Daniels | |
| 4,071,924 | A | 2/1978 | Meyn | |
| 4,508,405 | A * | 4/1985 | Damon et al. | 439/260 |
| 4,583,798 | A | 4/1986 | Blazowich | |
| 4,681,385 | A | 7/1987 | Kruger et al. | |
| 5,174,763 | A * | 12/1992 | Wilson | 439/66 |
| 5,316,503 | A | 5/1994 | Thompson et al. | |
| 5,409,403 | A | 4/1995 | Falossi et al. | |
| 5,425,645 | A | 6/1995 | Skovdal et al. | |
| 5,728,600 | A | 3/1998 | Saxelby, Jr. et al. | |
| 5,803,750 | A | 9/1998 | Purington et al. | |
| 5,945,831 | A | 8/1999 | Sargent et al. | |
| 5,984,687 | A | 11/1999 | Schwarz | |
| 6,149,448 | A | 11/2000 | Haller et al. | |
| 6,190,180 | B1 | 2/2001 | Purington et al. | |
| 6,609,931 | B2 | 8/2003 | Parrish et al. | |
| 6,945,805 | B1 | 9/2005 | Bollinger | |
| 7,029,289 | B2 * | 4/2006 | Li | 439/66 |
| 7,261,601 | B1 | 8/2007 | Chen | |
| 7,264,486 | B2 | 9/2007 | Ma | |
| D556,142 | S | 11/2007 | Kudo et al. | |
| 7,331,795 | B2 * | 2/2008 | Duke | 439/66 |
| 2006/0141815 | A1 * | 6/2006 | Li | 439/66 |

* cited by examiner

*Primary Examiner*—Briggitte R Hammond
(74) *Attorney, Agent, or Firm*—Buchanan Nipper

(57) ABSTRACT

An electrical connector assembly for establishing an electrical connection (for signal or current transfer) between two circuits or wiring assemblies.

19 Claims, 11 Drawing Sheets

ORIENTATIONLESS SPRING PROBE RECEPTACLE ASSEMBLY

PRIORITY

This application claims the priority date of the provisional application entitled Orientationless Spring Probe Receptacle Assembly filed by Michael Maughan, Fred Jessup, Erik J. Cegnar, and David G. Alexander on Sep. 19, 2008 with application Ser. No. 61/098,692, the disclosure of which is incorporated by reference.

FIELD OF THE INVENTION

The present invention relates to electrical connectors and more particularly to orientationless electrical connectors.

BACKGROUND OF THE INVENTION

When making an electrical connection using wiring assemblies, one must orient the separate connectors so as to align their respective pins and slots. This ensures that the necessary signal is directed down the correct path as determined by the circuit's designer. Existing connectors for making contact between printed circuit boards, wiring assemblies, or combinations of the two, require precise alignment for proper engagement. It takes longer for the user to make the electrical connection if alignment is necessary than if it were unnecessary.

There are also applications which require a connection that can swivel to allow the wires on either side on the connection to spin without causing damage to said wires or the connection itself. Some examples of these moving applications include, but are not limited to, hinges, transmission shafts and other assemblies which necessitate rotation about an axis, and handheld devices that require a wired connection.

DESCRIPTION OF THE PREFERRED EMBODIMENTS

Figure 1:
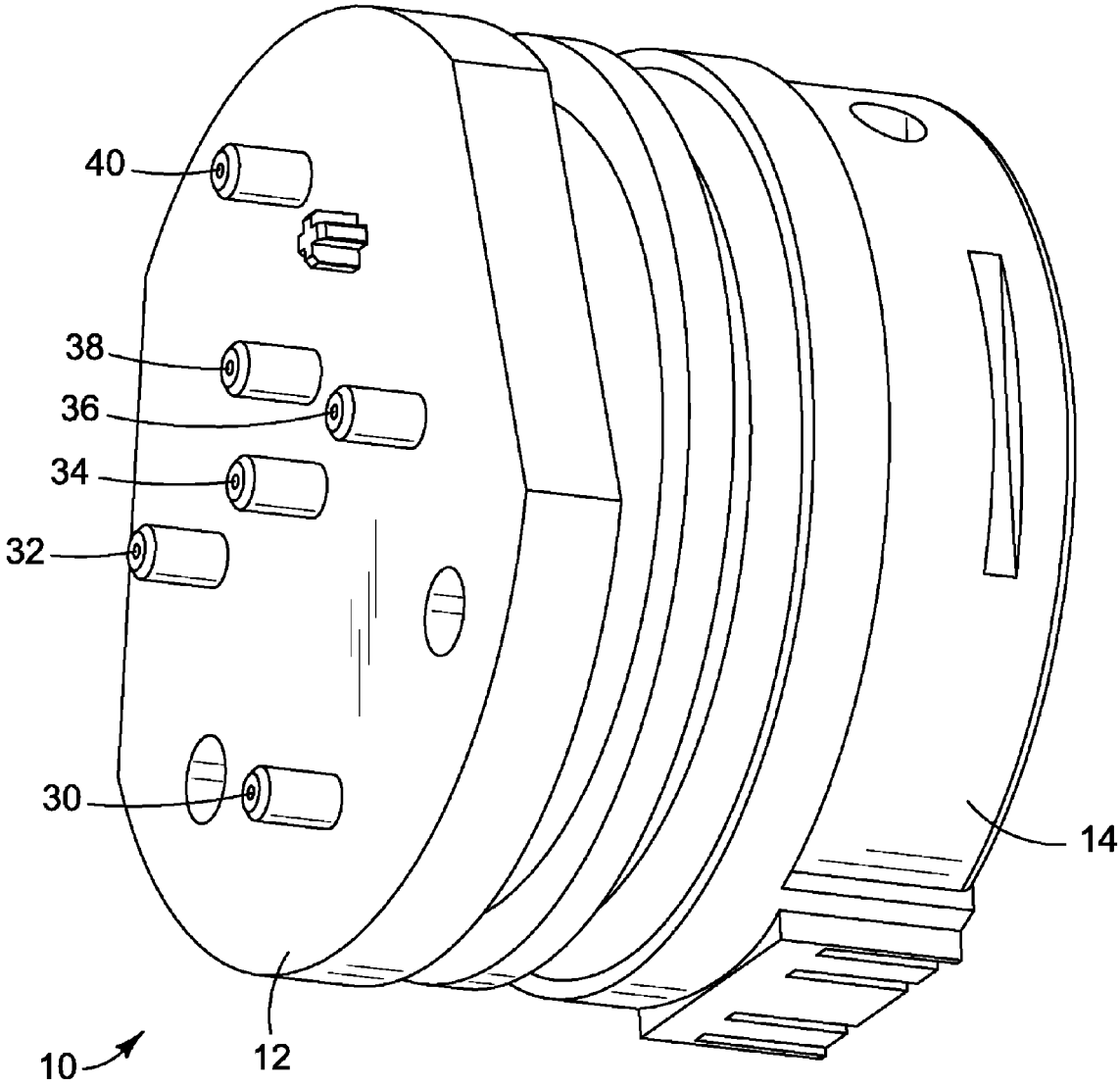
FIG. 1 is perspective view of one embodiment of the orientationless spring probe receptacle assembly.

While the invention is susceptible of various modifications and alternative constructions, certain illustrated embodiments thereof have been shown in the drawings and will be described below in detail. It should be understood, however, that there is no intention to limit the invention to the specific form disclosed, but, on the contrary, the invention is to cover all modifications, alternative constructions, and equivalents falling within the spirit and scope of the invention as defined in the claims.

In the following description and in the figures, like elements are identified with like reference numerals. The use of "e.g.," "etc," and "or" indicates non-exclusive alternatives without limitation unless otherwise noted. The use of "including" means "including, but not limited to," unless otherwise noted.

When making an electrical connection using wiring assemblies, one must orient the separate connectors to align with their respective pins and slots. This ensures that the necessary signal is directed down the correct path as determined by the circuit's designer. Some applications require a connection that can swivel to allow the wires on either side on the connection to spin without causing damage to said wires or the connection itself.

The present invention is a spring probe receptacle assembly 10 for establishing an electrical connection (for signal or current transfer) between two circuits or wiring assemblies, preferably regardless of the axial orientation of the connectors with respect to one another. This assembly could be used for carrying information, electrical signals, power, or current (e.g., high current). High current applications are available due to the large amount of surface area the connection is configured to establish when engaged. A method of manufacturing the receptacle assembly is likewise disclosed.

Figure 14:
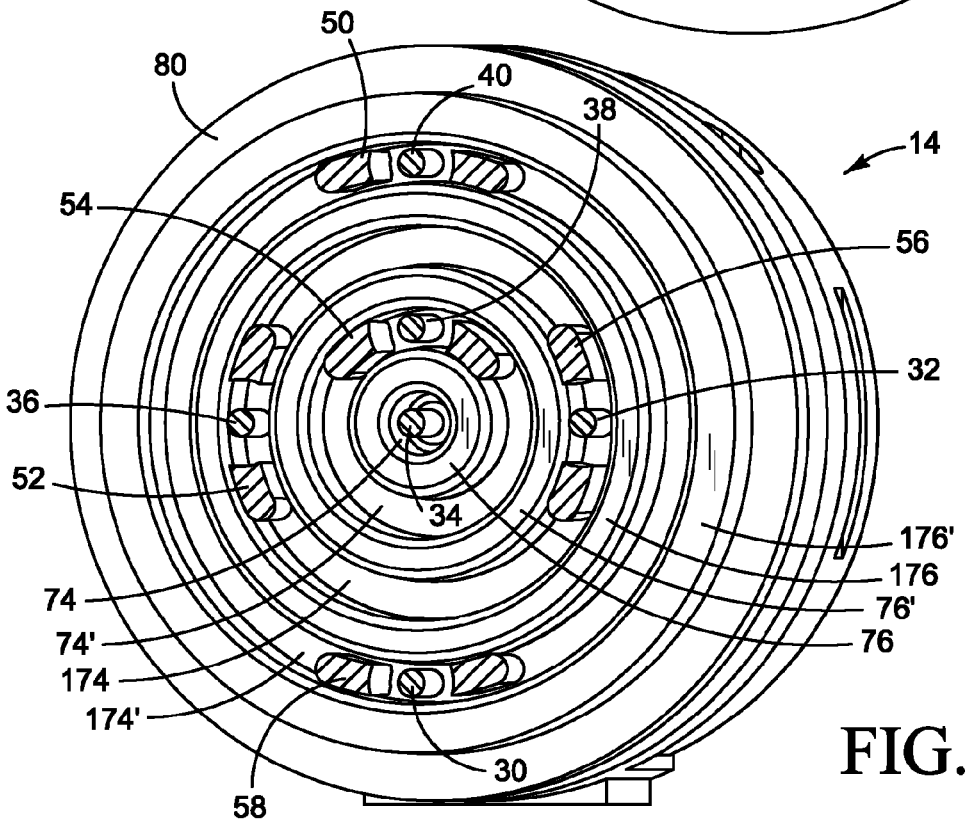
FIG. 14 is a partial, perspective, section view of the embodiment of FIG. 1, showing the probe tabs within the channels.
Figure 15:
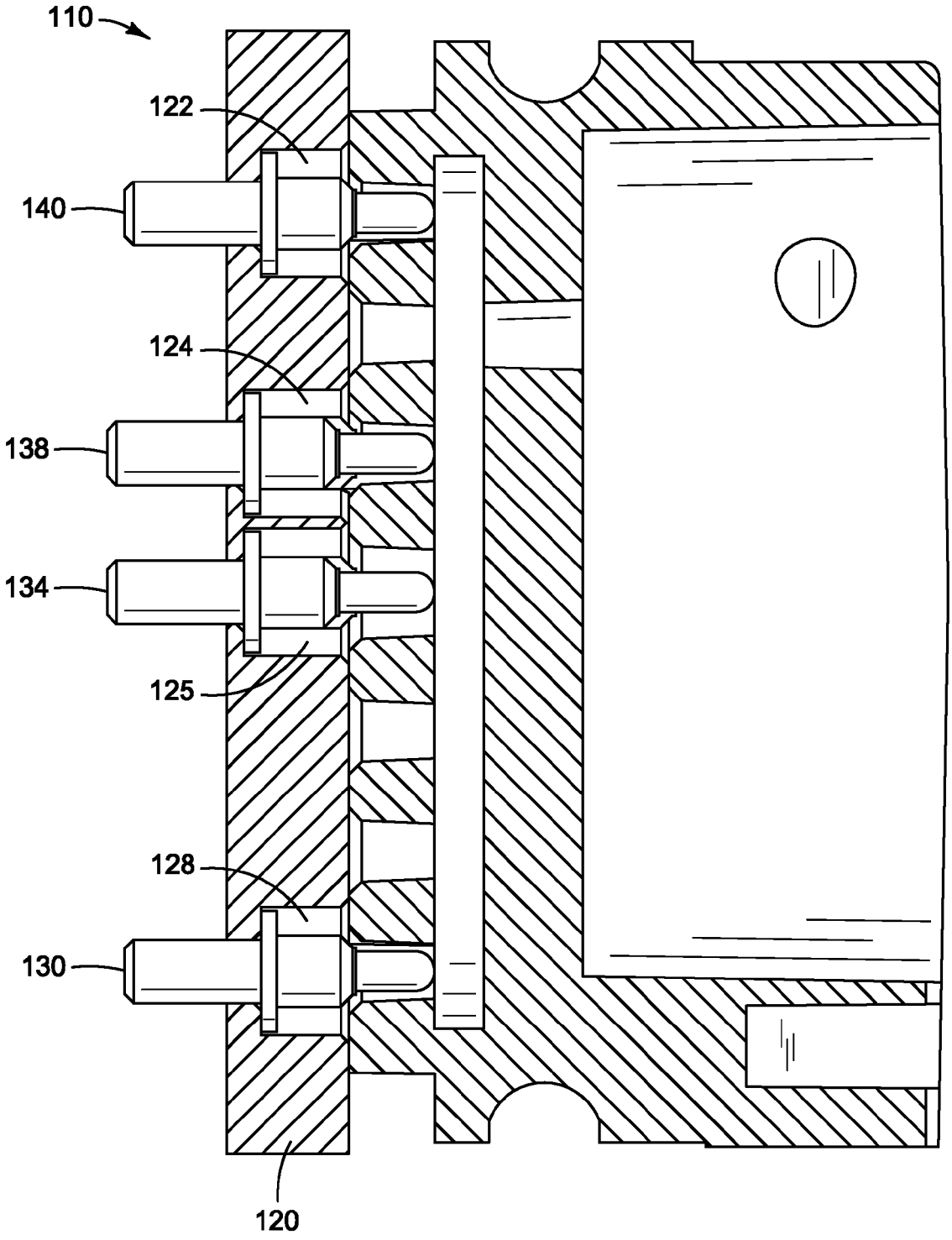
FIG. 15 is a partial section view of an embodiment like the embodiment of FIG. 1, with the probes and the printed circuit board not shown sectioned.

FIGS. 1-14 show the preferred embodiment of the spring probe receptacle assembly 10. FIG. 15 shows a second embodiment. The assembly 10 comprising a plug assembly 12 and a socket assembly 14.

Figure 6:
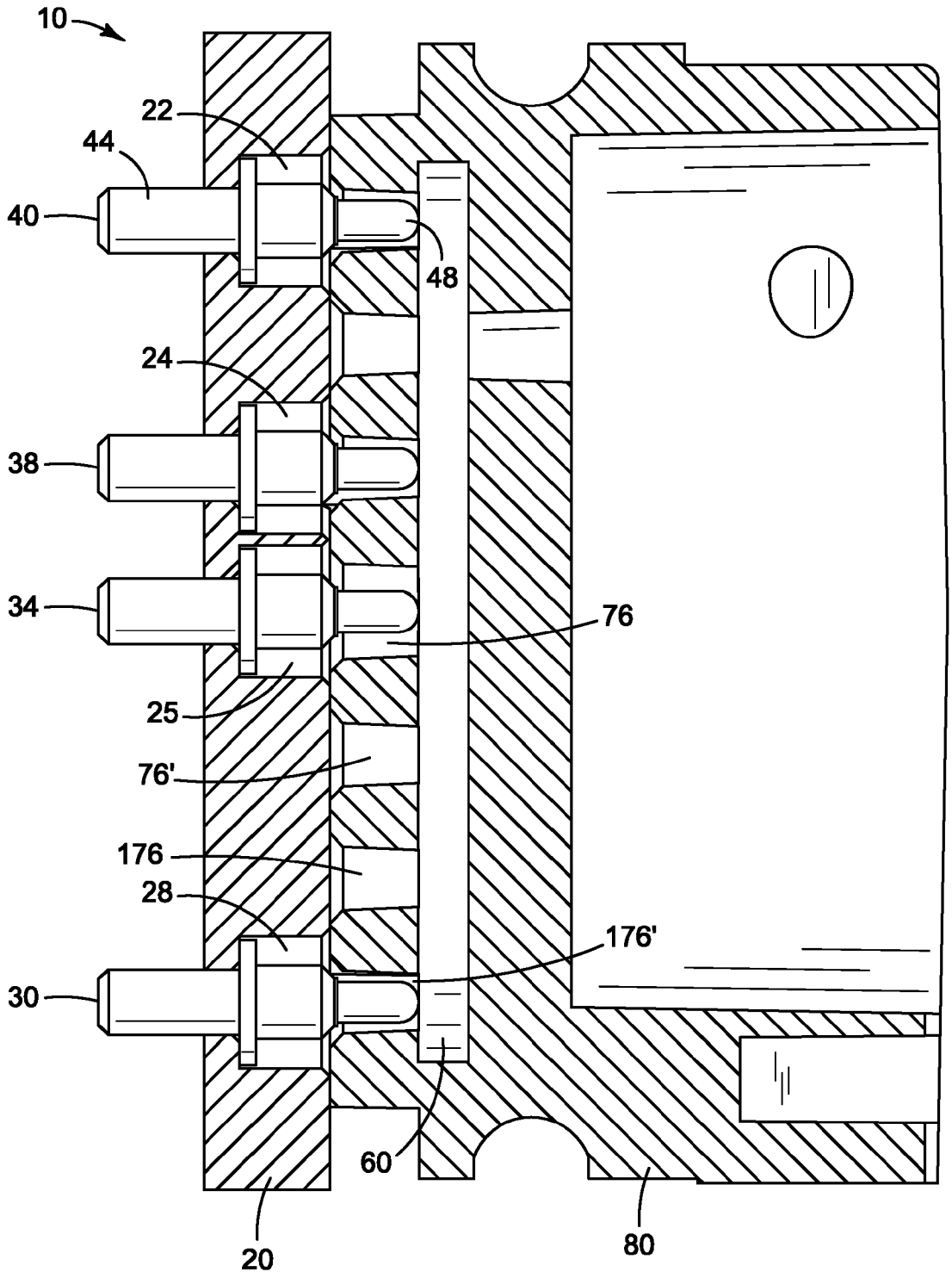
FIG. 6 is a partial section view of the embodiment of FIG. 1, with the probes and the printed circuit board not shown sectioned.
Figure 7:
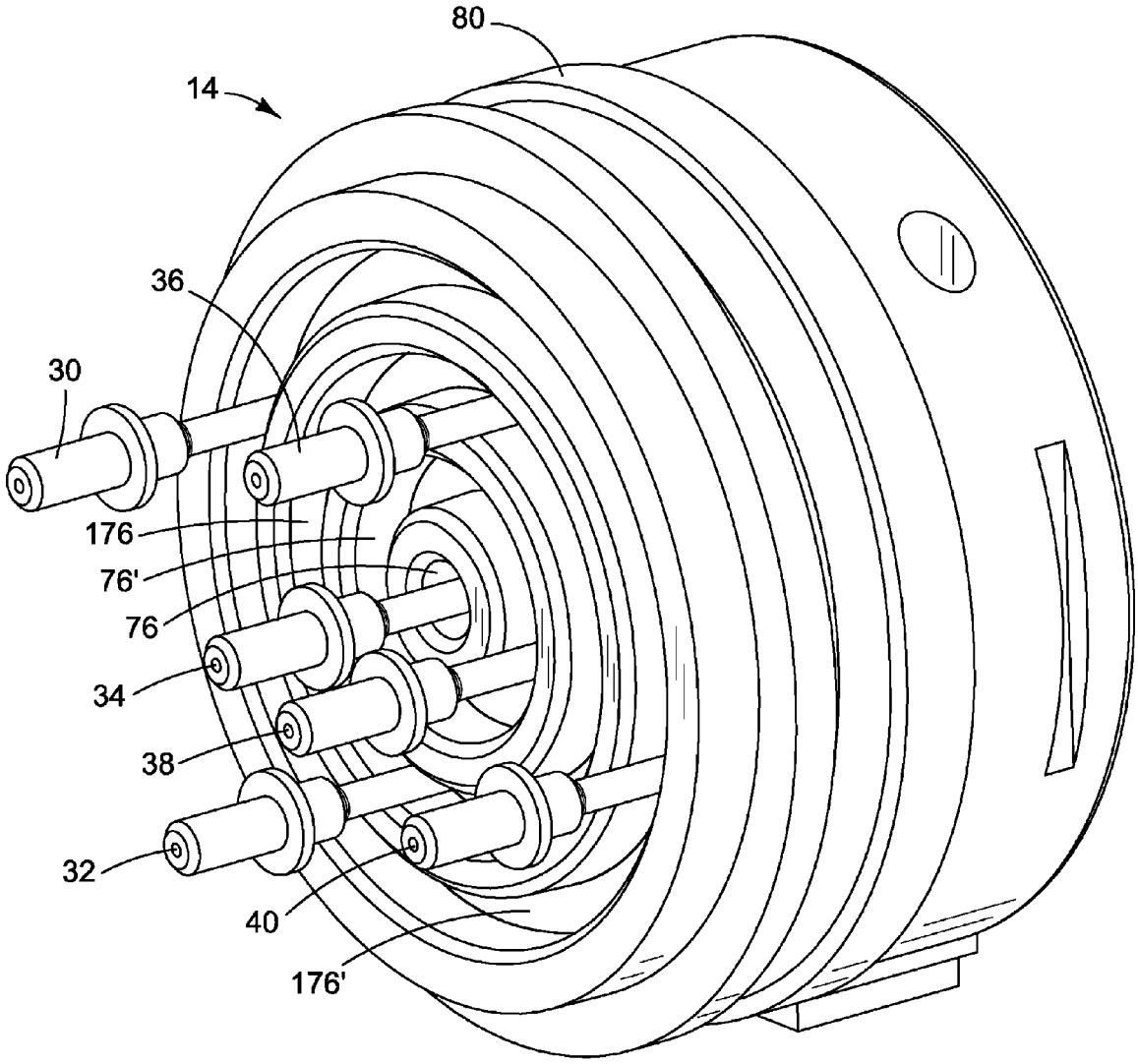
FIG. 7 is a partial perspective view of the embodiment of FIG. 1, not showing the base of the plug assembly and showing the probes uncompressed.

Referring initially to FIGS. 1, 2, 3 and 4, shown is the plug assembly 12 mated to the socket assembly 14, the plug electrically connecting with the socket. FIGS. 6 and 7 likewise show this mating.

Figure 3:
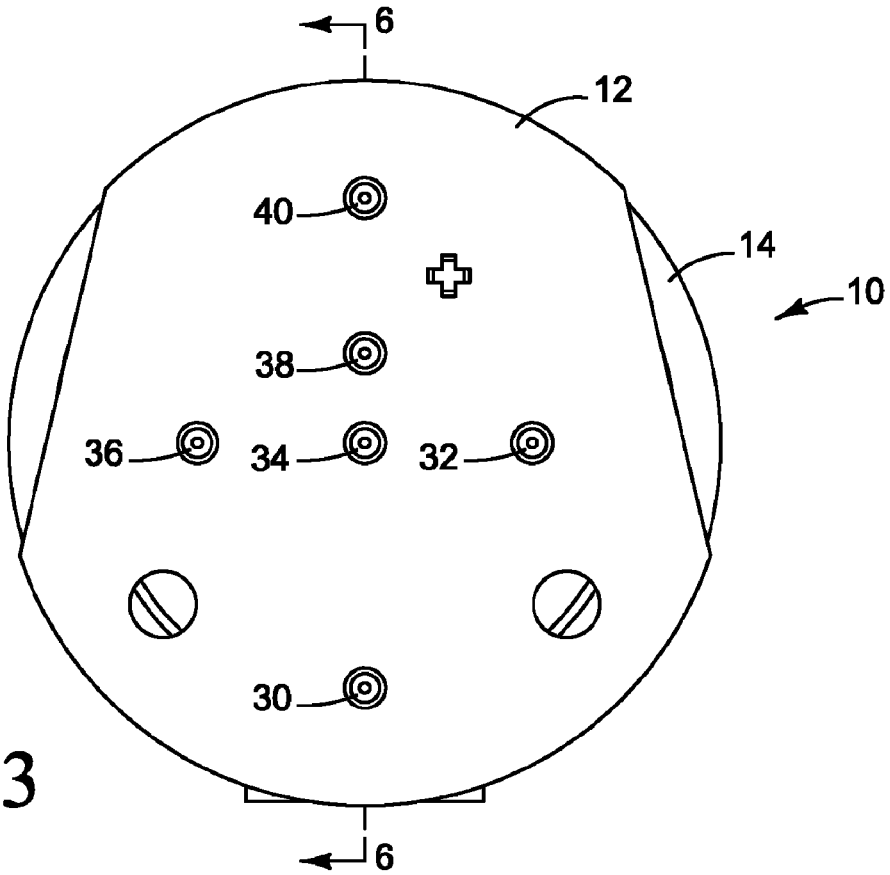
FIG. 3 is an end view from the plug end of the receptacle assembly.
Figure 4:
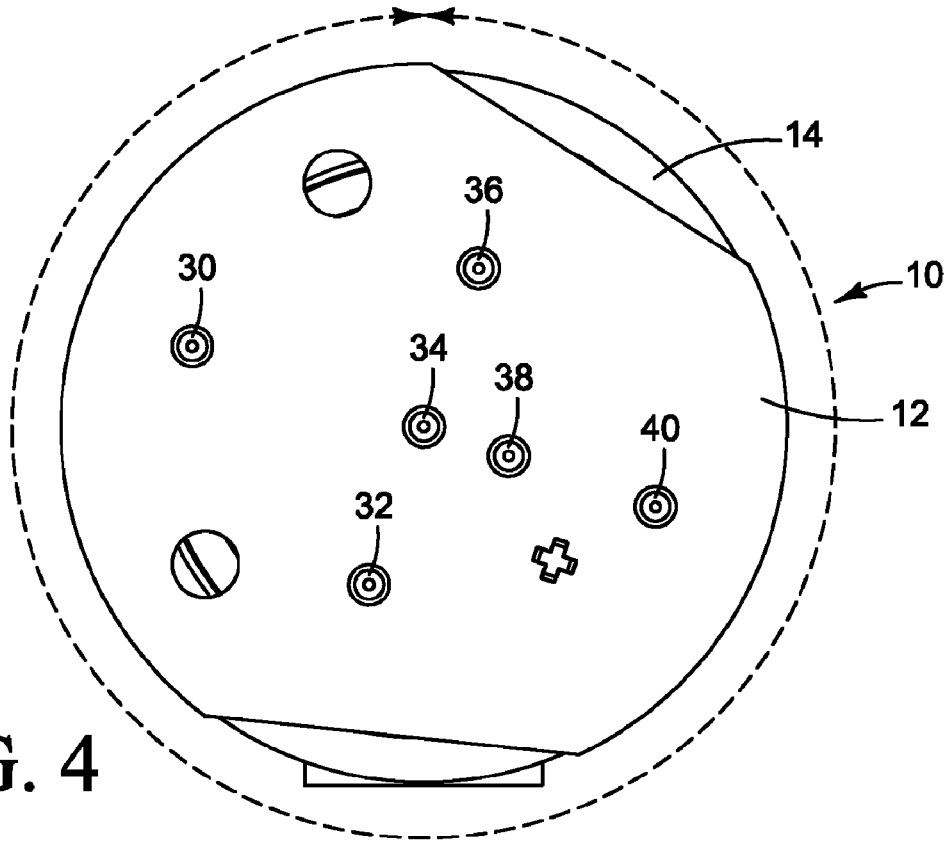
FIG. 4 is a second end view, as shown in FIG. 3, showing the rotation of the plug assembly relative to the socket assembly.

It is preferred that spring probe receptacle assembly be orientationless, thereby enabling it to be electrically connected 360 degrees around one axis, preferably axisymmetric. The orientationless configuration implemented in the preferred embodiment is illustrated in FIGS. 3 and 4 where the plug assembly 12 is configured to be able to rotate separately from the socket assembly 14.

Figure 5:
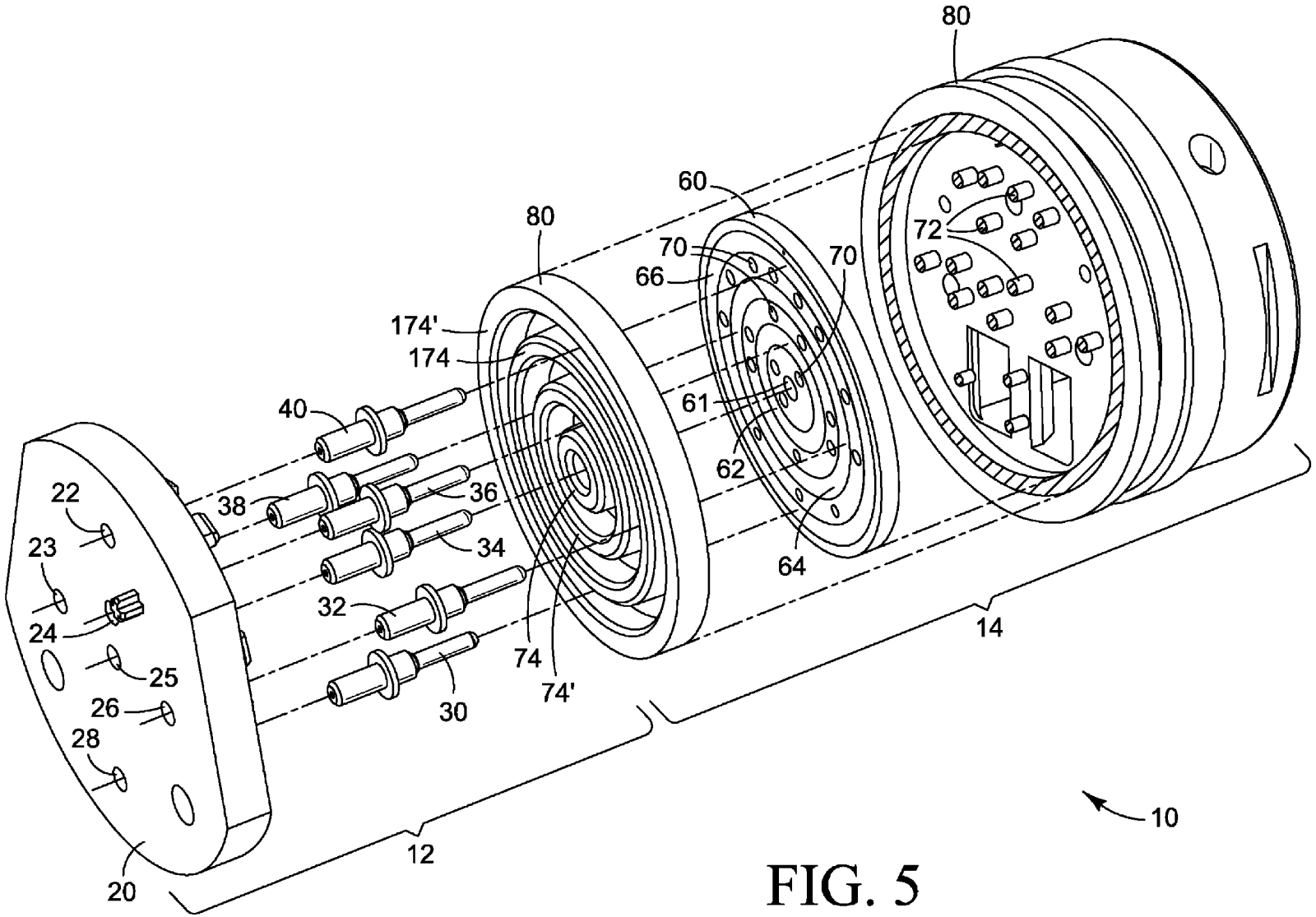
FIG. 5 is an exploded view of the embodiment of FIG. 1.

FIG. 5 shows an exploded view of the embodiment of FIG. 1. The socket assembly 14 comprising a printed circuit board (PCB) 60 that is designed to have multiple concentric electrical contact rings (61, 62, 64, 66) formed from a conductive material with a body 80 made of suitable injection moldable or casting material (e.g., a thermoplastic) formed around and surrounding the PCB. The centermost "ring" 61 in this embodiment comprising a generally circular contact. The electrical contact rings also referred to herein as stationary electrical contacts.

In the embodiment shown, the body 80 (made of plastic) is molded around the PCB 60 in a plastic injection molding process. This process forms a hermetic seal between the PCB 60 and the body 80, allowing the socket assembly 14 to be used in devices that require an air and watertight seal. The socket assembly 14 is simple and inexpensive to manufacture because it is designed to be built with modern injection molding, PCB manufacturing, and PCB assembly techniques.

FIGS. 5-7 showing that the body 80 includes a number of socket guides (74, 74', 174, 174') that extend from the front face 94 (shown in FIG. 8) of the PCB 60 thereby allowing the PCB contact rings (61, 62, 64, 66) to be recessed from the outermost surfaces and therefore protected from mechanical stress, abrasion, and substances such as mud or chemicals, that could cause contamination. The socket guides also decrease the likelihood that a person or conductor will inadvertently contact the connections. FIG. 7 showing a partial perspective view of the embodiment of FIG. 1, not showing the base of the plug assembly and showing the probes uncompressed. The PCB also having a rear face 96, shown in FIG. 9.

The socket guides (74, 74', 174, 174') defining a plurality of channels 76, 76', 176, 176' there-between (also shown in FIG. 6) through which spring contact probe plunger portions 48 can be inserted and brought into contact with an electrical contact ring. The socket guides 74, 74', 174, 174' thus configured to guide the contact probes (61, 62, 64, 66) into the correct position. When rotated, the plunger portion rides along the contact ring within the channel and is shrouded by socket guide when engaged. When interfaced, the plug assembly and the socket assembly may rotate independent of one another by said spring contact probe plunger portions riding along contact rings, resulting in the orientationless configuration illustrated in FIGS. 3 and 4 (discussed above). The plug assembly and socket assembly removably interfaced together so that they can be unplugged from one another if so desired.

Figure 10:
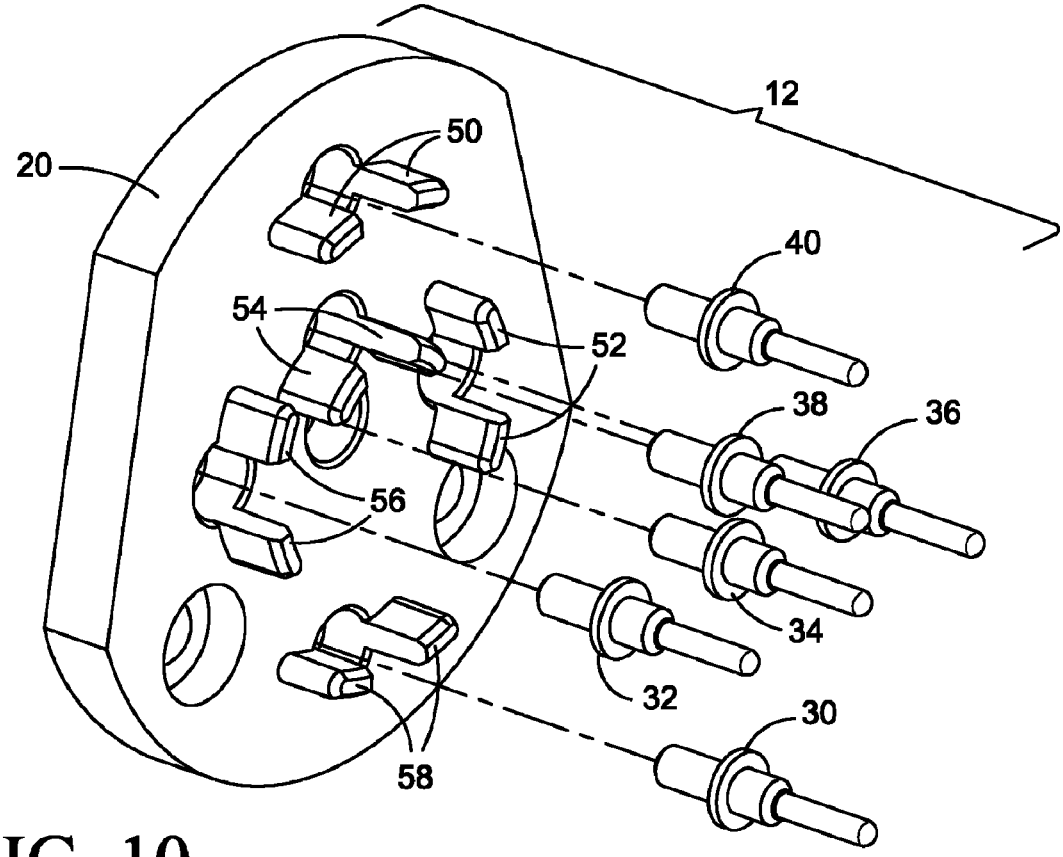
FIG. 10 is an exploded view of the plug assembly of FIG. 1.
Figure 11:
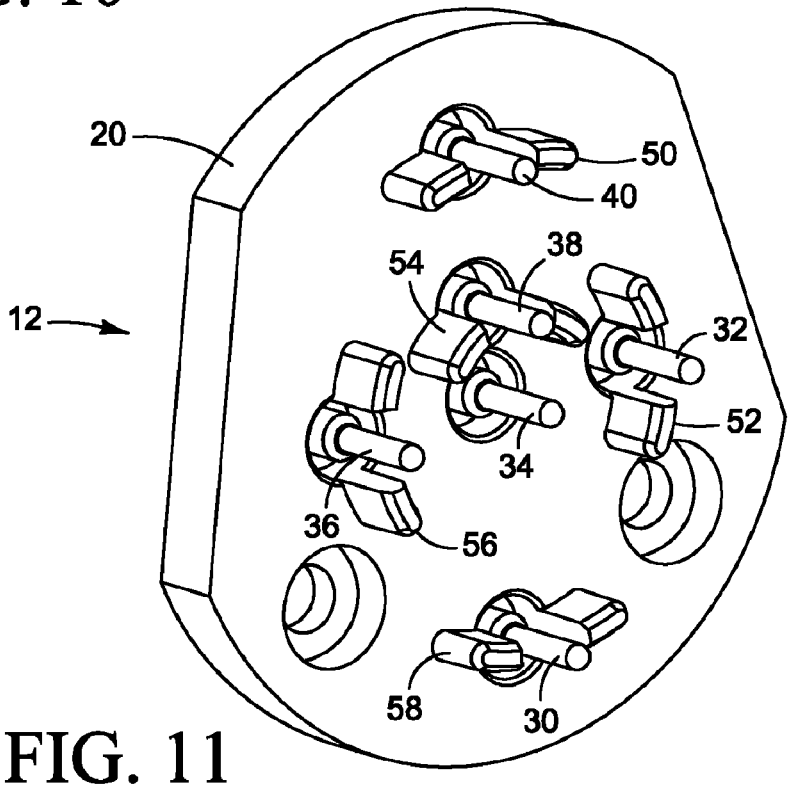
FIG. 11 is a non-exploded view of what is shown in FIG. 10.
Figure 13:
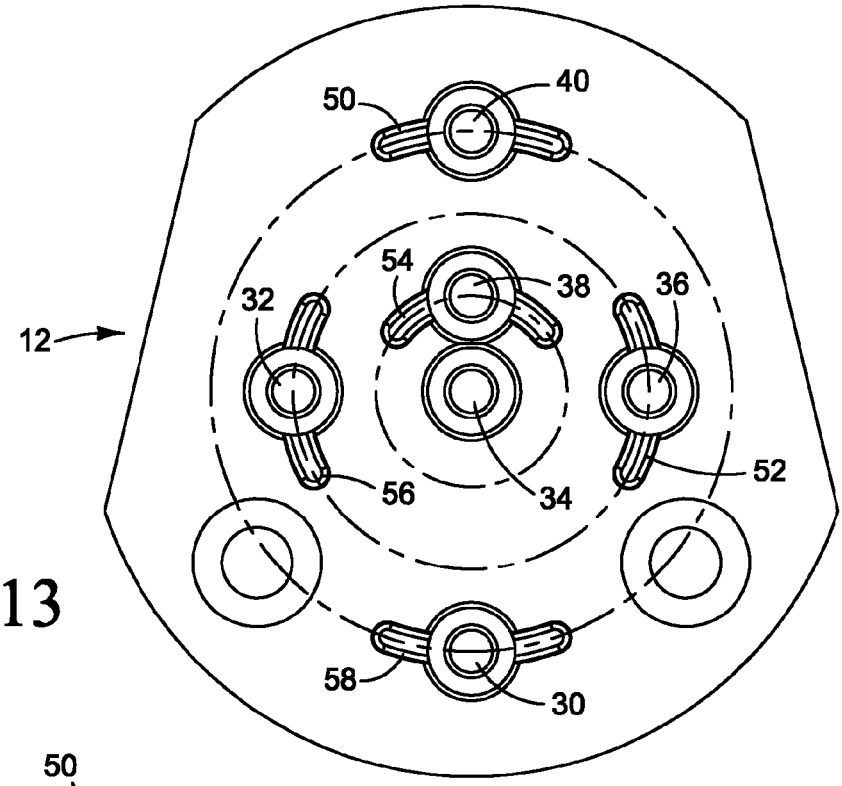
FIG. 13 is a partial, transparent end view of the receptacle assembly of FIG. 1, showing probe paths.

The plug assembly 12 comprising a base 20 having a plurality of spring probe contact receivers defined therein, these spring probe contact receivers (22, 23, 24, 25, 26, 28) configured for connecting with the barrel portion of a spring probe contact (30, 32, 34, 36, 38, 40). As shown in FIGS. 10, 11, 13 and 15, it is further preferred that the base 20 comprise a plurality of generally curving probe tab 50, 52, 54, 56, 58 adjacent said spring probe contact receivers, these probe tabs for interfitting relationship within the channels (76, 76', 176, 176') further guiding the contact probes into the correct position. FIG. 10 showing an exploded view of the plug assembly of FIG. 1, FIG. 11 showing is a non-exploded view of what is shown in FIG. 10, FIG. 13 showing is a partial, transparent end view of the receptacle assembly of FIG. 1, showing probe paths, and FIG. 14 showing a partial, perspective, section view of the embodiment of FIG. 1, showing the probe tabs within the channels.

Preferably, the spring probe contacts (30, 32, 34, 36, 38, 40) comprise a barrel portion 44 for receiving a spring (not shown) therein, the spring biasing a plunger portion 48. The plunger portion 48 configured for contacting a contact ring of the PCB and electrically connecting the plug assembly 12 to the socket assembly 14. The plunger portion 48, upon rotation of the plug assembly and/or the socket assembly (as shown in FIGS. 3, 4 and 6), able to provide pressure on and travel along the contact ring, maintaining the electrical connection when interfaced. The barrel portion 44 of the spring probe contacts terminating in an end configured for electrical connection to a circuit board, wiring assembly or other electrical component.

In such a configuration, the spring probe receptacle assembly 10 is capable of carrying very high currents in the range of 20 A per contact ring. The contact rings (61, 62, 64, 66) can each receive multiple spring probe contacts (30, 32, 34, 36, 38, 40), as shown in FIG. 7. Thus, current capacity can be increased by the addition of more spring probe contacts.

Preferred method of manufacture. The PCB 60 is manufactured through typical PCB manufacturing techniques. The PCB 60 is then placed into a mold cavity and plastic is injected, surrounding the PCB 60 and filling the cavity, thereby forming the body 80. It is preferred that the PCB 60 have defined there-through a plurality of plated holes 70, the plated holes allowing material to flow through the PCB 60 (represented by the tubes 72 of FIG. 5) when the body 80 is formed there-around, the body 80 thereby having the PCB enclosed there-in (as shown in FIG. 6). Having body material extend through the plated holes serves to support the outside rings from mechanical stress and impacts.

Figure 2:
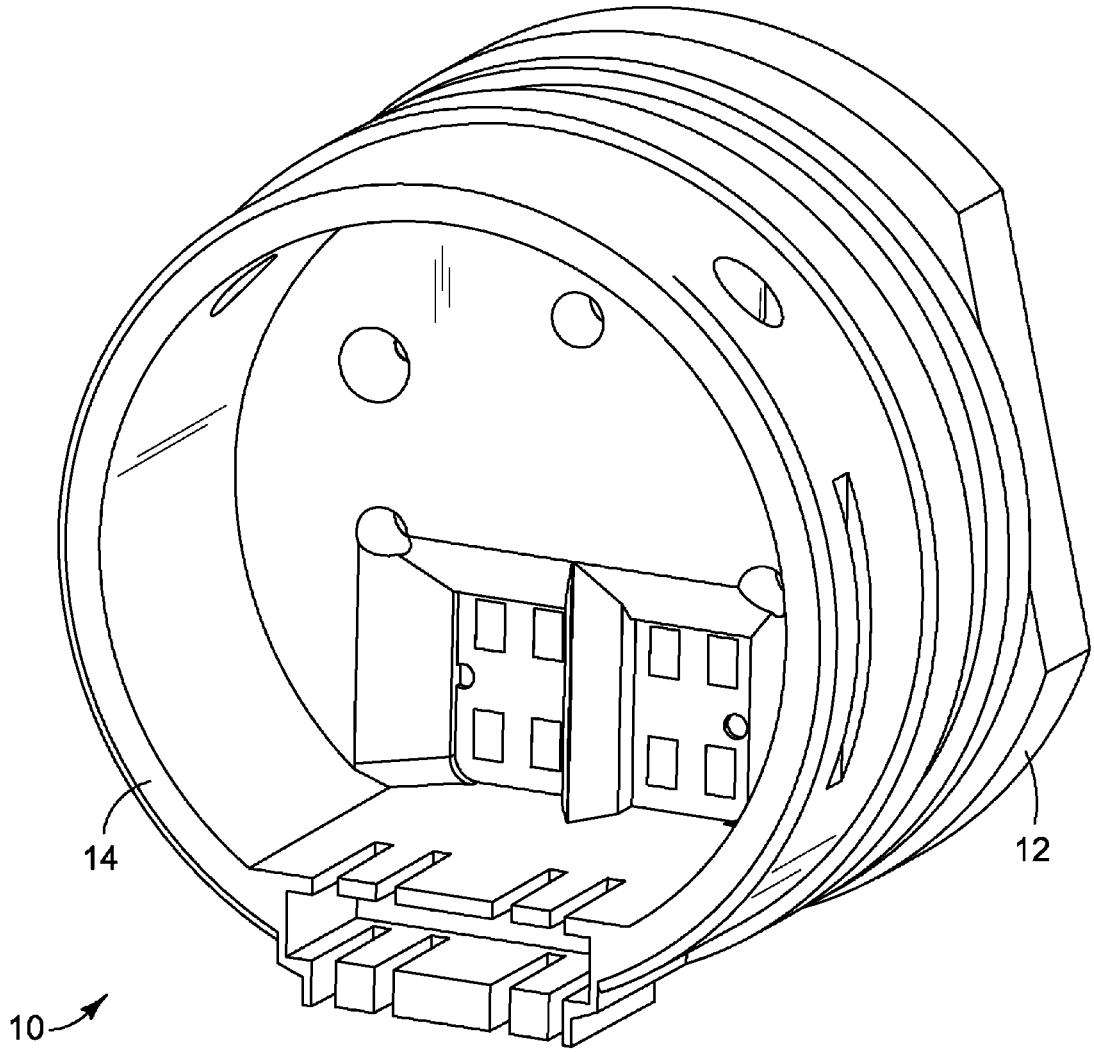
FIG. 2 is a second perspective view of the embodiment of FIG. 1.
Figure 12:
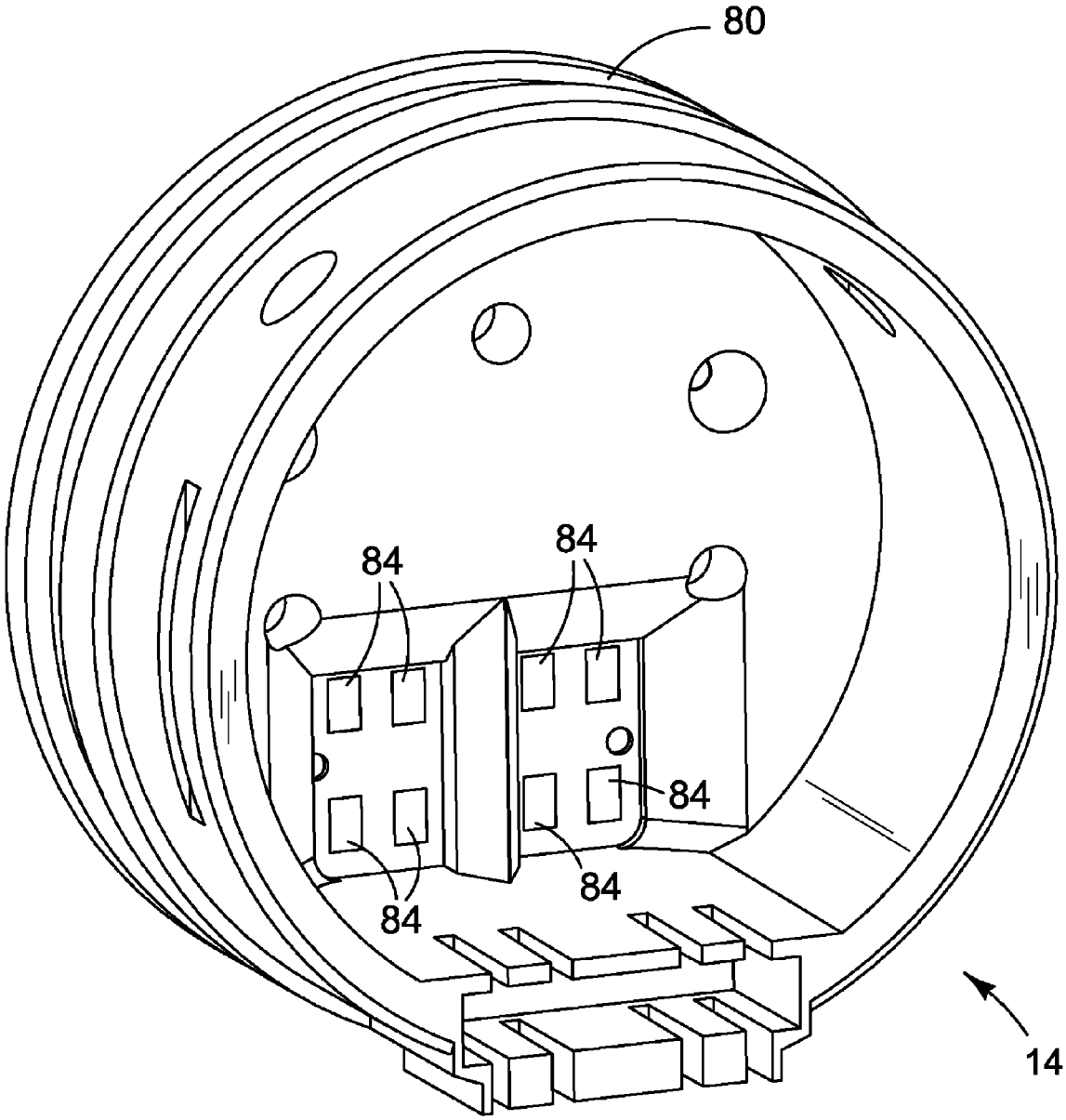
FIG. 12 is an exploded view of the socket assembly of FIG. 1.

It is preferred that the mold be designed so that it exerts pressure on the PCB ring contacts and front face 94 during the molding process. This leaves the ring contacts exposed after the molding process, forming the channels (76, '76, 176, '176) and the socket guides (74, 74', 174, 174') is completed and therefore accessible by the spring probes. Mold pressure is also placed on the back face 96 of the PCB in order to leave pads 84 exposed on the back side of the PCB 60 as shown in FIGS. 2 and 12.

Figure 8:
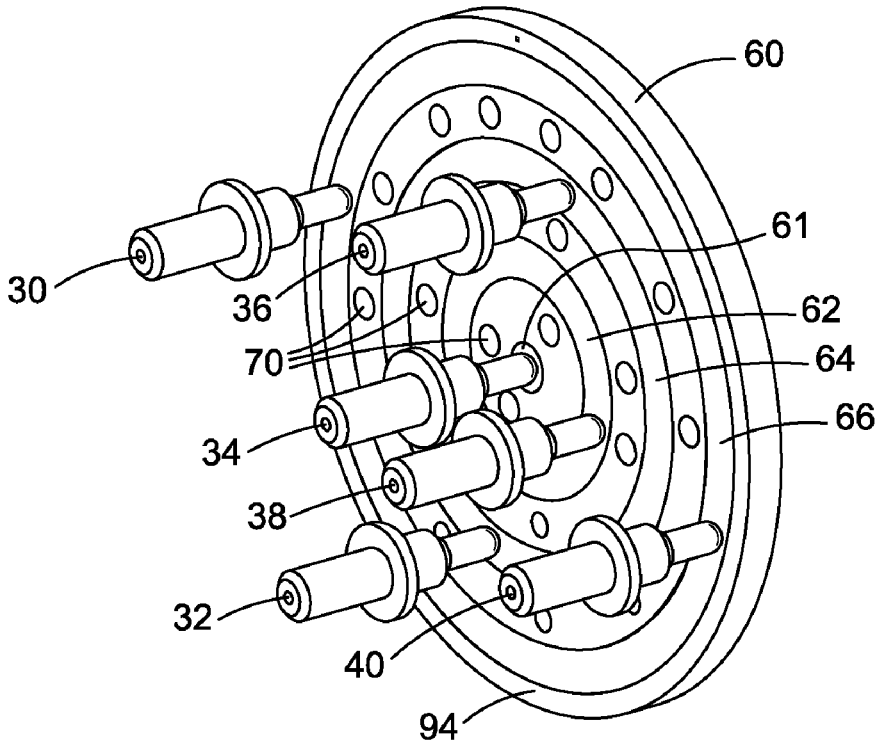
FIG. 8 is a partial perspective view, showing the interaction of the probes and the printed circuit board.
Figure 9:
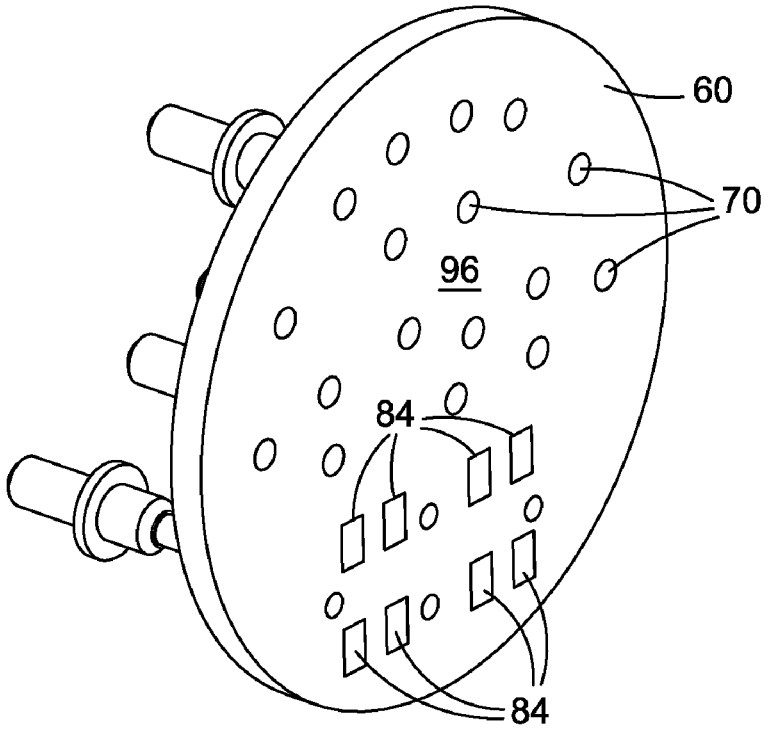
FIG. 9 is a second partial perspective view like FIG. 8, showing the interaction of the probes and the printed circuit board.

The PCB 60 is preferably manufactured such that several plated holes 70 and vias connect the contact rings (61, 62, 64, 66) on the front of the PCB 60 to traces on the back of the PCB 60. The traces are connected to the exposed pads 84 on the back of the PCB 60. FIGS. 8 and 9 are partial views (sans body 80) that show this connection in detail.

The spring probe receptacle assembly can be manufactured in a wide range of sizes and can be scaled by adding as many rings and spring probes as the design calls for. The spring probe receptacle assembly also providing support and proper alignment for the spring probe contacts.

FIG. 6 is a section view of the plug assembly 12 and the socket assembly 14 aligned for interface and illustrates how the plug assembly 12 and the socket assembly 14 connect to form an electrical interface. When interfaced, an electrically conductive pathway is established omnidirectionally between the pads (FIG. 9) of the socket assembly 14 to the end of said barrel portions 44 of the spring contact probes (30, 34, 38, 40) in the plug assembly 12. Any number of contact rings and spring contact probes can be utilized to provide the necessary number of signal paths required. An individual signal is propagated either to or from said end of said barrel portion via the tip of the plunger portion 48 contacting the contact ring via its PCB electrical connection with pad 84, or the inverse thereof, as shown in FIG. 12.

In the embodiment shown in FIG. 6, the spring contact probes (30, 34, 38, 40) are all the same size, configuration and are similarly mounted on the base 20. That results in the tips of the plunger portions lying in the same plane when the plug assembly and the socket assembly are not interfaced. In the embodiment 110 shown in FIG. 15, the receivers (124, 125) for spring contact probes 134 and 138 are slightly deeper than the receivers (122, 128) for spring contact probes 130 and 140. Such a configuration would result in, when the plug assembly is not interfaced with the socket assembly, the tips of the plunger portions of spring probe contacts 134 and 138 being spaced closer to the base 120 than the tips of the plunger portions of spring probe contacts 130 and 140. Such a configuration allowing, when the plug and socket are being interfaced, for the electrical connections (between contact rings and spring contact probes) to be made in a predetermined sequence. Other ways of structuring such a sequential connection could likewise be configured, including but not limited to using different sizes/shapes of spring contact probes.

FIG. 8 is a partial perspective view, showing the interaction of the probes (30, 32, 34, 38, 40) and the printed circuit board 60, from the contact ring side of the PCB. FIG. 9 is a second partial perspective view like FIG. 8, showing the interaction of the probes (30, 32, 34, 38, 40) and the printed circuit board 60, from the back side of the PCB. In these views, the material that comprises the body of the socket assembly and the base of the plug assembly are not shown, for illustrative purposes.

There are many applications for the preferred embodiment ranging from permanent to momentary connections. In one example application, the connector is used between a handheld device and its charging base station. Since this electrical connector can be made to spin, it is also useful in applications where one side of the electrical connection must be able to rotate freely from the other side of the connection.

One embodiment comprising a spring probe receptacle assembly for making electrical contact between two circuit boards, wiring assemblies, or a combination of the two, comprising a socket assembly and a plug assembly. The socket and plug assemblies configured to removably interface with each other to form an electrical connection. The socket assembly containing a printed circuit board having a front face and a back face, the front face containing a plurality of stationary electrical contacts configured in a circular orientation. Preferably the printed circuit board comprises a plurality of plated holes defined there-through extending from the front face to the back face.

The plug assembly containing a plurality of spring contact probes. The spring contact probes are preferably configured to provide pressure on the stationary electrical contacts, when interfaced, sufficient to provide electrical connection. The receptacle assembly further comprising a plurality of socket guides partially surrounding the stationary electrical contacts. The socket guides configured to guide the spring contact probes into the correct position and to protect said stationary electrical contacts from accidental contact with electrically conductive objects. The socket guides defining a plurality of channels there-between. It is preferred that the stationary electrical contacts and the spring contact probes are configured in an axisymmetric orientation such that electrical contact is established between the plug assembly and the socket assembly regardless of the plug assembly and the socket assembly's respective rotational orientation. Preferably, the plug assembly and the socket assembly are configured to form a watertight electrical connection when interconnected. Preferably, the plug assembly further comprises a plurality of curved probe tabs adjacent the spring contact probes, the curved probe tabs configured for receipt into the channels. It is preferred that the stationary electrical contacts be contained within the same plane, being parallel and equidistant from the back face of the socket assembly and that the spring contact probes be generally parallel to one another. When interfaced, a stationary electrical contact can be simultaneously contacted by two or more spring contact probes, thereby allowing higher current to be conducted through the connector. Additionally, it is preferred that a body be molded around the printed circuit board, the plurality of socket guides extending from the body, and body extending through the plated holes.

The exemplary embodiments shown in the figures and described above illustrate but do not limit the invention. It should be understood that there is no intention to limit the invention to the specific form disclosed; rather, the invention is to cover all modifications, alternative constructions, and equivalents falling within the spirit and scope of the invention as defined in the claims. For example, while the exemplary embodiments illustrate use with wire bundles or signal lines, the invention is not limited to use with these and may be used with other forms of signal propagation as rotating circuit cards or automotive applications. While the invention is not limited to use with wired systems, it is expected that various embodiments of the invention will be particularly useful in such devices. Hence, the foregoing description should not be construed to limit the scope of the invention, which is defined in the following claims.

The purpose of the Abstract of the Disclosure is to enable the public, and especially the scientists, engineers, and practitioners in the art who are not familiar with patent terms, legal terms or phraseology, to determine quickly from a cursory inspection, the nature and essence of this technical disclosure. The Abstract of the Disclosure is neither intended to define the invention of the application, which is measured by the claims, nor is it intended to be limiting as to the scope of the invention in any way.

What is claimed is:

1. A spring probe receptacle assembly for making electrical contact between two circuit boards, wiring assemblies, or a combination of the two, comprising:

a socket assembly and a plug assembly, said socket and plug assemblies configured to removably interface with each other to form an electrical connection;

a plurality of stationary electrical contacts contained within said socket assembly, wherein said stationary electrical contacts are configured in a circular orientation;

a plurality of spring contact probes contained within said plug assembly, wherein said spring contact probes are configured to provide pressure on said stationary electrical contacts, when interfaced, sufficient to provide electrical connection;

a plurality of socket guides partially surrounding said stationary electrical contacts, wherein said socket guides are configured to guide said spring contact probes into the correct position, said socket guides defining a plurality of channels therebetween; and whereby said stationary electrical contacts and said spring contact probes are configured in an axisymmetric orientation such that electrical contact is established between said plug assembly and said socket assembly regardless of said plug assembly and said socket assembly's respective rotational orientation.

2. The spring probe receptacle assembly of claim 1, wherein said plug assembly and said socket assembly are configured to form a watertight electrical connection when interconnected.

3. The spring probe receptacle assembly of claim 1, wherein said plug assembly further comprises a plurality of curved probe tabs adjacent said spring contact probes, said curved probe tabs configured for receipt into said channels.

4. The spring probe receptacle assembly of claim 1, wherein said stationary electrical contacts are contained within the same plane, being parallel and equidistant from the back face of said socket assembly.

5. The spring probe receptacle assembly of claim 1, wherein at least one of said stationary electrical contacts is simultaneously contacted by two or more spring contact probes.

6. The spring probe receptacle assembly of claim 1, wherein said spring contact probes are generally parallel to one another.

7. The spring probe receptacle assembly of claim 1, wherein said plurality of spring contact probes comprises a first spring contact probe and a second spring contact probe, wherein said first and second spring contact probes comprise plungers, said plungers terminating in tips, said tips configured for contacting said stationary electrical contacts, wherein said first and second spring contact probes are mounted to said plug assembly offset from one another so that said tips, when not interfaced with said stationary electrical contacts, are not located in the same plane, thereby enabling the plungers to sequentially connect with their respective stationary electrical contacts when said socket assembly and said plug assembly are interfaced together.

8. The spring probe receptacle assembly of claim 1, wherein said socket guides are configured to protect said stationary electrical contacts from accidental contact with electrically conductive objects.

9. The spring probe receptacle assembly of claim 1, wherein said plurality of stationary electrical contacts are defined on a front face of a printed circuit board, said printed circuit board having a back face opposite said front face, said printed circuit board comprising a plurality of plated holes defined there-through extending from the front face to the back face.

10. The spring probe receptacle assembly of claim 9, wherein a body is molded around said printed circuit board, said plurality of socket guides extending from said body, said body extending through said plated holes.

11. A spring probe receptacle assembly for making electrical contact between two circuit boards, wiring assemblies, or a combination of the two, comprising:

a socket assembly comprising a printed circuit board having a plurality of stationary electrical contacts configured in a circular orientation, said printed circuit board having a front face and a back face, said socket assembly further comprising a plurality of socket guides partially surrounding said stationary electrical contacts, said socket guides extending generally perpendicularly from said front face, said socket guides defining a plurality of channels, wherein said socket guides are configured to guide said spring contact probes into the correct position, and further configured to protect said stationary electrical contacts from accidental contact with unintended electrically conductive objects; and a plug assembly comprising a base and a plurality of spring contact probes, wherein said spring contact probes have plunger portions configured for insertion into said socket assembly channels for making an electrical connection with said stationary electrical contacts when said socket assembly and said plug assembly are interfaced;

wherein said stationary electrical contacts and said spring contact probes are configured in an axisymmetric orientation such that electrical contact may be established and maintained between said plug assembly and said socket assembly regardless of said plug and socket assemblies' respective rotational orientation;

wherein said socket and plug assemblies configured to removably interface with each other to form an electrical connection.

12. The spring probe receptacle assembly of claim 11, wherein said plug assembly and said socket assembly are configured to form a watertight electrical connection when interconnected.

13. The spring probe receptacle assembly of claim 11, wherein said plug assembly further comprises a plurality of curved probe tabs adjacent said spring contact probes, said curved probe tabs configured for receipt into said channels.

14. The spring probe receptacle assembly of claim 11, wherein said stationary electrical contacts are contained within the same plane, being parallel and equidistant from the back face of said socket assembly.

15. The spring probe receptacle assembly of claim 11, wherein at least one of said stationary electrical contacts is simultaneously contacted by two or more spring contact probes.

16. The spring probe receptacle assembly of claim 11, wherein said spring contact probes are generally parallel to one another.

17. The spring probe receptacle assembly of claim 11, wherein said printed circuit board comprising a plurality of plated holes defined there-through extending from the front face to the back face.

18. The spring probe receptacle assembly of claim 17, wherein a body is molded around said printed circuit board, said plurality of socket guides extending from said body, said body extending through said plated holes.

19. The spring probe receptacle assembly of claim 11, wherein said plurality of spring contact probes comprises a first spring contact probe and a second spring contact probe, wherein the plungers of said first and second spring contact probes terminating in tips, wherein said first and second spring contact probes are mounted to said plug assembly offset from one another so that said tips, when not interfaced with said stationary electrical contacts, are not located in the same plane, thereby enabling the plungers to sequentially connect with their respective stationary electrical contacts when said socket assembly and said plug assembly are interfaced together.

* * * * *